US006258417B1

(12) United States Patent
Goswami et al.

(10) Patent No.: US 6,258,417 B1
(45) Date of Patent: Jul. 10, 2001

(54) METHOD OF PRODUCING NANOCOMPOSITE COATINGS

(75) Inventors: Ramasis Goswami, Stony Brook; Sanjay Sampath, Setauket; John Parise, East Setauket; Herbert Herman, Port Jefferson, all of NY (US)

(73) Assignee: Research Foundation of State University of New York, Albany, NY (US)

( * ) Notice: Subject to any disclaimer, the term of this patent is extended or adjusted under 35 U.S.C. 154(b) by 0 days.

(21) Appl. No.: 09/276,319

(22) Filed: Mar. 26, 1999

Related U.S. Application Data

(60) Provisional application No. 60/109,670, filed on Nov. 24, 1998.

(51) Int. Cl.[7] ..... C23C 4/04

(52) U.S. Cl. ..... 427/452; 427/446; 427/455

(58) Field of Search ..... 427/446, 452, 427/447, 450, 453, 455, 456

(56) References Cited

U.S. PATENT DOCUMENTS

| | | | |
|---|---|---|---|
| 4,003,770 | 1/1977 | Janowiecki et al. . | |
| 4,048,348 | 9/1977 | Bailey et al. . | |
| 4,228,142 | 10/1980 | Holcombe, Jr. et al. . | |
| 4,292,342 | 9/1981 | Sarma et al. . | |
| 4,377,564 | 3/1983 | Dahlberg . | |
| 5,453,303 | 9/1995 | Holcombe, Jr. et al. . | |
| 5,635,254 | 6/1997 | Holcombe et al. . | |
| 5,759,634 | 6/1998 | Zang . | |
| 5,772,760 | 6/1998 | Gruen et al. . | |
| 5,939,146 * | 8/1999 | Lavernia | 427/446 |

FOREIGN PATENT DOCUMENTS

| | | |
|---|---|---|
| 0622471 | 11/1994 | (EP) . |
| 2295400 | 5/1996 | (GB) . |
| 9718341 | 5/1997 | (WO) . |

OTHER PUBLICATIONS

Clare et al., "Metals Handbook—Ninth Edition," American Society for Metals, vol. 5, 361–363 (1982) (no month date).

Mailhot, K., et al., *Proc. of the 15th Int'l Thermal Spray Conf.,* p. 1419 (May 25–29, 1998).

Morvan, D. et al., *Proc. of the 15th Int'l. Thermal Spray Conf.,* p. 511 (May 25–29, 1998).

Heberlein, J. et al., *Thermal Spray: A United Forum for Scientific and Technological Advances,* p. 329 (1997). (no month date).

HV–2000 Brochure, Praxair Surface Technologies, Inc., N670 Communication Dr., Appleton, WI 54915, (920) 734–9292 (1997). (no month date).

Scandolo, S. et al., *Phys. Rev. Let.,* 74:20, p. 4015 (1995). (no month date).

Neiser, R. A., et al., *Proc. of the 1993 Thermal Spray Conf.,* p. 61 (Jun. 7–11, 1993).

Application for U.S. Patent 08/003,274, filed Jan. 12, 1993, abandoned.

Erskine, D. J. and William, J. N., *J. Appl. Phys. 71*:10, p. 4882 (1992). (no month date).

Canham, L. T., *Appl. Phys. Let.,* 57:10, p. 1046 (1990). (no month date).

(List continued on next page.)

*Primary Examiner*—Katherine A. Bareford
(74) *Attorney, Agent, or Firm*—Baker Botts L.L.P.

(57) ABSTRACT

A method of producing a nanocomposite coating without gaseous precursor reactants. A non-nanocrystalline particulate containing a polymorphic material in an atmospheric phase is introduced into a high-velocity gas jet. The projected particulate is allowed to impact a substrate at a velocity effective to cause at a least a portion of the polymorphic material to transform to a nanocrystalline, high pressure phase.

11 Claims, 7 Drawing Sheets

OTHER PUBLICATIONS

Kowalsky, K. A., et al., *Thermal Spray Res. and App., Proc. of the 3rd Nat. Thermal Spray Conf.,* p. 587 (May 20–25, 1990).

Pirouz, P. et al., *Mater,* 38:2, p. 313 (1990). (no month date).

Hanfland, M., et al., *Phys. Rev. B,* 39:17, p. 39 (1989). (no month date).

Stiffler S. R. and Thompson M.O., *Phys. 1 Rev. Let.,* 60:24, p. 2519 (1988). (no month date).

Besson J. M., et al., *Phys. Rev. Let. 59*:4, p. 473 (1987) (no month date).

Zhao et al., *Solid State Comm.,* 59:10, p. 679 (1986). (no month date).

Shaner, J. W., et al., *Jour. de Physique,* 45, p. C8–235 (1984). (no month date).

Gust, W. H. and Royce E. B., *J. of Appl. Phys.,* 42:5, p. 1897 (1971). (no month date).

DPV–2000 Brochure, Technar Automation LTEE, 3502 First Street, St. Hubert, Quebec, Canada J3Y 8Y5, (450) 443–5335, <http://tecnar–automation.com>. (no date).

Wentorf, R. H., "Diamond", Bever, M. B. ed., *Encyclopedia of Materials Science and Engineering,* vol. 2., The Pergamon Press and The MIT Press, Oxford, p. 1139 (no date).

* cited by examiner-

METHOD OF PRODUCING NANOCOMPOSITE COATINGS

RELATED APPLICATIONS

The present application claims priority under 35 U.S.C. §119(e) from Provisional Application No. 60/109,670, filed Nov. 24, 1998.

Development of the invention disclosed herein was made with support from the National Science Foundation under Grant No.: DMR 9632570. Accordingly, the U.S. Government may have rights in the disclosed invention.

FIELD OF THE INVENTION

The present invention relates to a method of producing shock-induced nanocomposite coatings, and more particularly to a method of producing shock-induced nanocomposite coatings with thermal or plasma spraying.

BACKGROUND OF THE INVENTION

A "nanocomposite coating" is a coating having more than one solid phase, in which at least one phase is in the nanometer range. Attention has been directed to nanoparticles and nanocomposites because of the unique properties exhibited by these materials. For example, Silicon (Si) is an indirect band gap semiconductor that can be potentially used for optoelectronic applications such as light emitting devices. Unfortunately, the development of such devices has been hindered since crystalline Si is not an efficient light emitter. However, this changed with the development of porous-Si (por-Si), an irregular network of nanocrystalline Si which exhibits a band gap energy twice the band gap energy of crystalline Si (L. T. Canham, Appl. Phys. Lett. 57(10):1046–1048 (1990)). Thus, the potential applications of semiconductor materials, such as Si, have increased because of the development of nanomaterials.

Typically, nanocrystalline or nanocomposite coatings are produced using chemical techniques such as Chemical Vapor Deposition (CVD), which require gaseous reactants and vacuum chambers to contain the gaseous reactants. However, the use of these gaseous reactants involves safety risks, in addition to time and cost considerations associated with containment of the gaseous reactants. Thus, for mass scale production of nanocrystalline or nanocomposite coatings CVD techniques are not without disadvantages.

An common alternative to CVD is thermal or plasma spraying, which uses a particulate precursor material rather than a reactive gas. Thermal or plasma spray provides a flexible, cost-effective and safer method for producing coatings since gaseous reactants are avoided. Moreover, vacuum chambers are generally avoided since the coatings are typically sprayed at atmospheric pressure.

However, nanocrystalline or nanocomposite coatings produced solely with plasma or thermal spraying have yet to be developed. While combinations of CVD and thermal spraying have been used to produce nanocrystalline coatings (Heberlein et al., Thermal Spray: A United Forum for Scientific and Technological Advances, 329–333 (1997)), reactive precursor gases are still required to form the nanocrystalline coating.

In view of the current state of the art, there is a need for a method of producing nanocrystalline or nanocomposite coatings without reliance on gaseous precursor reactants.

Accordingly, it is an object of the present invention to provide a method of producing nanocomposite coatings without the use of reactive precursor gases. It is also an object of the present invention to provide a method of producing nanocomposite coatings having metastable, high pressure phases of nanocrystalline material.

SUMMARY OF THE INVENTION

The present invention provides a method of producing a nanocomposite coating which avoids the disadvantages associated with gaseous precursor reactants. The method includes providing a thermal or plasma spray apparatus capable of generating a high-velocity gas jet, providing a substrate to be impinged by the gas jet, generating the high-velocity gas jet and introducing into the gas jet a particulate containing a polymorphic material in an atmospheric phase. The substrate is positioned at a distance from the spray apparatus where the particulate impinges the substrate at a velocity effective to induce transformation of at least a portion of the polymorphic materials to a nanocrystalline, high pressure phase. If desired, the velocity can be greater than said velocity effective to induce transformation of at least a portion of said particulate to said nanocrystalline, high pressure phase. Moreover, the particulate can be dispersed in a carrier gas prior to being introduced into the high-velocity gas jet.

The particulate can have a particle size from 1 to 100 $\mu$m, with 5 to 50 $\mu$m being preferred. The particulate can be a semiconductor such as silicon, germanium, doped derivatives thereof, and combinations thereof.

The substrate to have the nanocomposite coating deposited therein is preferably an inorganic material, such as a metal or non-metal. One particularly preferred non-metal susbstrate is silicon.

The present also provides an article having a nanocomposite coating. The article is substrate having coated thereon the nancomposite coating which is a matrix of a polymorphic material in an atmospheric phase having dispersed therein nanocrystals of the polymorphic material in a high pressure phase. The coating can have a thickness from about 10 to about 500 micrometers. Preferably, the high pressure phase nanocrystals are at least 5 percent by volume of the nanocomposite coating, with at least 20 percent or or at least 50 percent being more prefered. Preferably, the nanocrystals range in size from about 1 to about 100 nanometers, with about 5 to about 50 nanometers being more prefered.

DETAILED DESCRIPTION OF THE INVENTION

Figure 1:
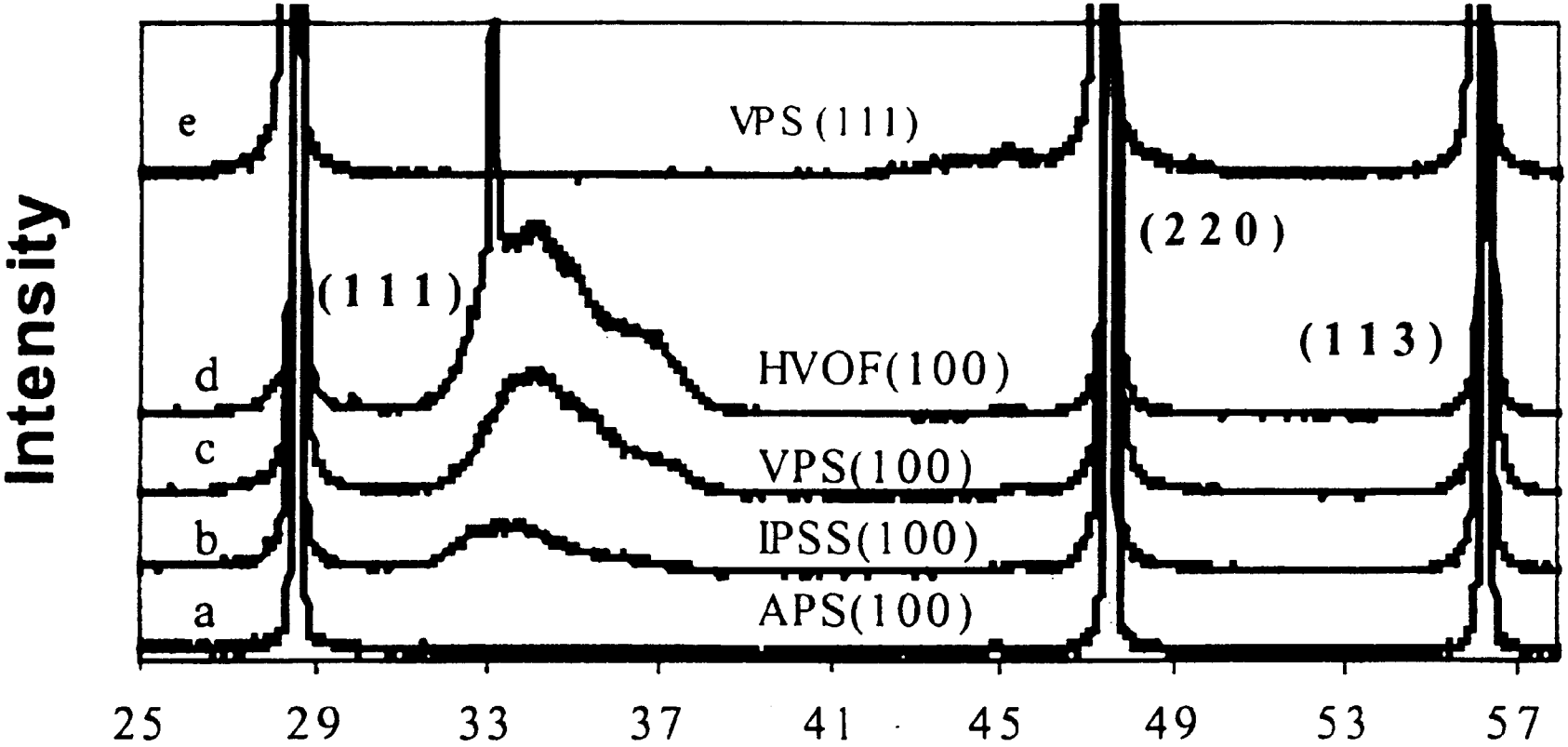
FIG. 1 is a composite of x-ray diffraction (XRD) patterns, patterns A–E, of silicon (Si) nanocomposite coatings produced in accordance with the present invention.

The present invention provides a method of producing a nanocomposite coating, while avoiding the disadvantages associated with the use of gaseous precursors. In accordance with the present invention, a nanocomposite coating is provided by thermal spraying a particulate containing a polymorphic material in an equilibrium phase at atmospheric pressure (i.e., atmospheric phase) onto a substrate at a velocity effective to induce transformation of the polymorphic material to a nanocrystalline, high pressure phase.

"Polymorphism" is defined as the property of a chemical substance being able to crystallize into two or more forms having different structures. See Dictionary of Scientific and Technical Terms, McGraw-Hill, $5^{th}$ Ed., 1994. Examples of polymorphic materials are abound in nature, with semiconductors such as silicon and germanium being representative examples. Semiconductor materials are in fact "pressure polymorphs", which are chemical substances that undergo a transformation from one crystalline phase to another upon the application of pressure. Thus, in the context of the present invention, the term "polymorph" or "polymorphic material" is meant to refer to "pressure polymorphs."

In accordance with the present invention, the polymorphic material is a crystalline material that exhibits a crystalline phase at room or atmospheric pressure and exhibits at least one different crystalline phase at elevated pressures. In the the context of the present invention, a crystalline phase exhibited at pressures greater than atmospheric is referred to as a "high pressure phase." Preferably, the polymorphic material stably transforms from its atmospheric phase to a high pressure phase upon application of pressure (i.e., should not revert back to its atmospheric phase after quenching).

In a preferred embodiment, the polymorphic material is a semiconductor. In another embodiment, the polymorphic material is a semiconductor other than diamond. Examples of semiconductors to be utilized in accordance with the present invention are Group IV and VI elements, semiconductors synthesized from these elements, and combinations thereof. Preferred examples of semiconductor are silicon, germanium, doped derivatives thereof, and combinations thereof. Silicon (Si) undergoes several transitions to high pressure phases at transition pressures ranging from about 10 Gigapascals (GPa) for Si-II, about 16 GPa for Si-V, about 37 GPa for Si-VI, about 42 GPa for hcp Si-VII, and about 78 GPa for fcc Si. In addition, other metastable forms of silicon (e.g., Si-IX, BC-8, R-8 and Si-IV) can be formed. Germanium (Ge) also undergoes a transition to high pressure phases at transition pressures ranging from about 10.6 GPa for Ge-II and about 75 for simple hexagonal Ge. Likewise, other metastable forms of germanium (e.g., ST-12, BC-8, hexagonal diamond) can be formed.

In accordance with the invention, a particulate containing the polymorphic material in its atmospheric phase is introduced to a high velocity gas jet in which the gas jet is directed to a substrate causing the particulate to impinge the substrate at a velocity effective to induce a portion of the polymorphic material to transform to a nanocrystalline, high pressure phase. An "effective" velocity in this context is a velocity at which the particulate impinges or impacts the substrate with a shock pressure equivalent to the transition pressure of the desired high pressure phase. While not wishing to be bound by theory, it is believed that by causing the particulate to impinge the substrate at a shock pressure (i.e., a Hugonoit pressure) equal to, or greater than, the transition pressure of the polymorphic material a phase transformation is induced from a non-nanocrystalline, atmospheric phase to nanocrystalline, high pressure phase. Specifically, a shock wave is generated when the particulate impacts the substrate. The wave propagates through the deposited coating and coating causing at least a portion of the deposited materials to transform to a nanocrystalline high pressure phase. A velocity effective to induce a phase transformation of a specific polymorphic material is calculated under shock loading from the modified Rankine-Hugonoit equation:

$$U_P = P_H / \rho_o U_S \quad (1)$$

where $P_H$ is the shock pressure, $\rho_o$ is the density of the polymorphic material, and $U_S$ is the velocity of the shock wave. In order for the transformation to occur $P_H$ must be equal to or greater than the transition pressure for the polymorphic material. The shock velocity is calculated by the equations:

$$U_S = a + bU_P \quad (2)$$

$$b = 0.5 + 3\alpha K / 2\rho_o Cv \quad (3)$$

where b is related to Guneisen parameter and expressed by Equation 3, a is the longitudinal velocity of sound, $\alpha$ is the linear thermal expansion coefficient of polymorphic material, K is the bulk modules of the polymorphic material and Cv is the specific heat of polymorphic material at constant volume. Thus, one skilled in the art can calculate the required effective particle velocity ($U_P$) upon ascertaining the other parameters of the modified Rankine-Hugonoit equation.

The high velocity gas jet is generated using any known apparatus for thermal or plasma spray techniques. As will be apparent those skilled in the art, the thermal or plasma spray apparatus must be capable of generating a gas jet having a velocity sufficient to reach the effective particle velocity for phase transformation to occur. However, reaching an effective velocity to induce phase transformation is dependent on both the velocity of the gas jet and the distance between the thermal spray apparatus and the substrate. One can therefore adjust the distance between spray apparatus and the substrate to provide the particulate with an effective velocity to induce transformation upon impact with the substrate. In addition, as will be apparent to those skilled in the art, other process parameters or conditions can be adjusted to alter particle velocity.

The requisite velocity to induce formation of the nanocrystalline, high pressure phase is also dependent on the polymorphic material to be deposited since different polymorphic materials have differing transition pressures. For example, to deposit a nanocomposite of Si, the thermal or plasma spray apparatus should provide the Si particulate with effective velocity before impact of at least 350 meters/seconds (m/s), with at least 400 meters/second being preferred. Examples of suitable thermal or plasma spray techniques that provide the above-described velocity requirements include, but are not limited to, vacuum plasma spraying, induction plasma with a supersonic nozzle, high velocity oxy-fuel (HVOF) spraying and non-combustive thermal spray processes such as solid state spray deposition. Low velocity spray techniques are not preferred since velocities of at least 300 m/s will be difficult to obtain.

Preferably, velocities in excess of the required effective velocities are used to increase to nanocrystalline content of the nanocomposite coating. For example, between 350 and 400 m/s micrometer Si particulate forms a nanocomposite coating having between 20–30% by volume of nanocrystalline, high pressure Si. However, at 800 m/s or greater, the same Si particulate forms a nanocomposite coating having greater than 50% by volume of nanocrystalline, high pressure Si. Thus, particle velocities in excess of the effective velocity for transformation provide greater yields of the nanocrystalline material.

The plasma or thermal spray apparatus should be capable of generating a gas jet having a temperature sufficient to at least partially melt the particulate to provide sufficient adhesion of the propelled particulate to the substrate. As will be apparent to those skilled in the art, the required temperature needed to melt the particulate will vary with the choice of the polymorphic material. Alternatively, the polymorphic material may be coated with a metal or other suitable adhesion promoting material that will soften or melt upon introduction to the gas jet to provide sufficient adhesion to the substrate. Example of metals to be used as adhesion promoters include, but are not limited to, nickel, iron and cobalt. Generally, the plasma or thermal spray apparatus should be capable of generating a gas jet having a temperature of at least 1000° C. While thermal and plasma spray techniques generating significantly higher temperatures can be used, such temperatures will also limit the choice of substrates.

Alternatively, if the polymorphic material is malleable, cold spray techniques may be used, such as solid-state spray deposition. Particle adhesion to the substrate is facilitated by the malleable nature of the polymorphic material. Advantageously, this provides an opportunity to coat substrates that would otherwise be detrimentally affected by the high temperatures associated with conventional thermal spray techniques.

The particulate of the invention contains the polymorphic material in an atmospheric phase and other optional components such as the adhesion promoters described above. Preferably, the particulate should have a particle size less than 100 microns, with a particle size less than 50 microns being preferred. Although larger particle size can be used, sufficient softening may not occur to allow the particulate to adhere to the substrate upon impact and particle velocity may be lessened. Morever, for ease of feeding into the spray apparatus, the particulate should have a particle size of at least 1 micron, with at least 5 microns being preferred. One particular advantage of the present invention, if desired, is that the use a high pressure phase seed material is avoided. Thus, to form the nanocomposite coating in accordance with the present invention only a particulate containing the atmospheric phase polymorphic material is required.

Depending on the technique selected, the particulate may be dispersed in an inert carrier gas prior to being introduced to the gas jet. Examples of carrier gases to be used include, but are not limited to, argon, helium, hydrogen, nitrogen and combinations thereof.

The substrates to be coated with the nanocomposite coating are materials that can withstand thermal or plasma spraying. The substrate can be an inorganic material such as a metal, semi-metal, non-metal, or can be an organic temperature resistant material. For example, the substrate can be a semiconductor in its atmospheric phase such as a silicon wafer (i.e., crystal) having deposited thereon a nanocomposite Si coating. Examples of metals to be coated include, but are not limited to, steel and aluminum. Likewise, the substrate can be in any shape or form that is capable of being coated with the nanocomposite coating.

The nanocomposite coating is a matrix of the polymorphic material in an atmospheric phase having dispersed therein nanocrystals of the polymorphic material is its high pressure phase. The nanocrystals range in size from about 1 to about 100 nanometers, with about 5 to about 50 nanometers being preferred. The size of the nanocrystals can be varied by adjusting the deposition pressure and the rate of pressure quenching.

Preferably, the nanocomposite coating has a nanocrystalline content of at least 5 percent by volume. However, following the teachings of the present invention, nanocomposite coatings with nanocrystalline contents of 20%, 50% or greater can be produced.

As will be apparent to those skilled in the art, the coating thickness is merely a function of coating time and other spray parameters. Generally, the coating can range in thickness from about 10 to about 500 micrometers ($\mu$m), with from about 20 to about 100 $\mu$m being more preferred.

The present invention also provides a nanocomposite coated article, which is prepared by coating a substrate, as described above, with a nanocomposite coating produced in accordance with the present invention. For example, the nanocomposite article be a silicon wafer having coated thereon a Si or Ge nanocomposite coating. In another embodiment, the article can have successive layers of different nanocomposites (e.g., a Si wafer having a Si nanocomposite coating, with an additional Ge nanocomposite coating on top of the Si coating). Thus, following the teachings of the invention, a variety of nanocomposite coated articles can be made.

Thus, the present invention provides a unique method of producing nanocomposite coatings that avoids the use of gaseous reactants, and nanocomposite articles of manufacture. The following non-limiting examples illustrate the use of the method of the present invention for the production of nanocomposite coatings.

EXAMPLE 1

Nanocomposite Si coatings were prepared in the following manner. Using the four thermal spray techniques: air plasma spray (APS), vacuum plasma spray (VPS), induction plasma spray with a supersonic nozzle (IPSS) and high velocity oxy-fuel spray (HVOF), electronic-grade Si powder (5 to 20 micrometers particle size) was injected into the high-energy flame. The resulting stream of molten Si particles was directed towards Si wafers of two orientations, (100) and (111), where the particles impacted the substrate. The substrates were positioned approximately 6 to 9 inches from the nozzle of the thermal spray gun. Upon impact, the droplets spread and solidified rapidly. The deposited coatings were built up by successive deposition of the droplets until coatings approximately 15 to 30 micrometers thick were formed on the single-crystal Si wafers. The process parameters are listed in Table 1 set forth below.

TABLE 1

Process Parameters for Thermal Spray Techniques

| Spray Processes/Spray Gun | Gas Composition | Velocity (m/s) |
|---|---|---|
| APS (Sulzer Metco 3MB) | Air | 50–200 |
| IPSS (Tekna PL70) | $Ar + N_2$ | 350–550 |
| VPS (Plasma Technik A.G. F4V) | $Ar + H_2$ (5:1) | 400–600 |
| HVOF (Praxair HV-2000) | $C_3H_6 + O_2$ (1:4.5) | 600–1000 |

The Si coatings were characterized by x-ray diffraction (XRD), transmission electron microscopy (TEM), and electron diffraction. FIG. 1 shows the XRD patterns of Si deposited on the Si (100) wafer using the four above described techniques (patterns A–D), and of the Si deposited on the Si (111) wafer using VPS (pattern E). A prominent broad peak was observed in the 2θ range between 31.7 to 38.6 in addition to Si-I (Si in its atmospheric phase) for the IPSS, VPS and HVOF deposits. However, this broad peak was absent from pattern (a) which is the deposits coated on a Si (100) wafer with APS.

Figure 2:
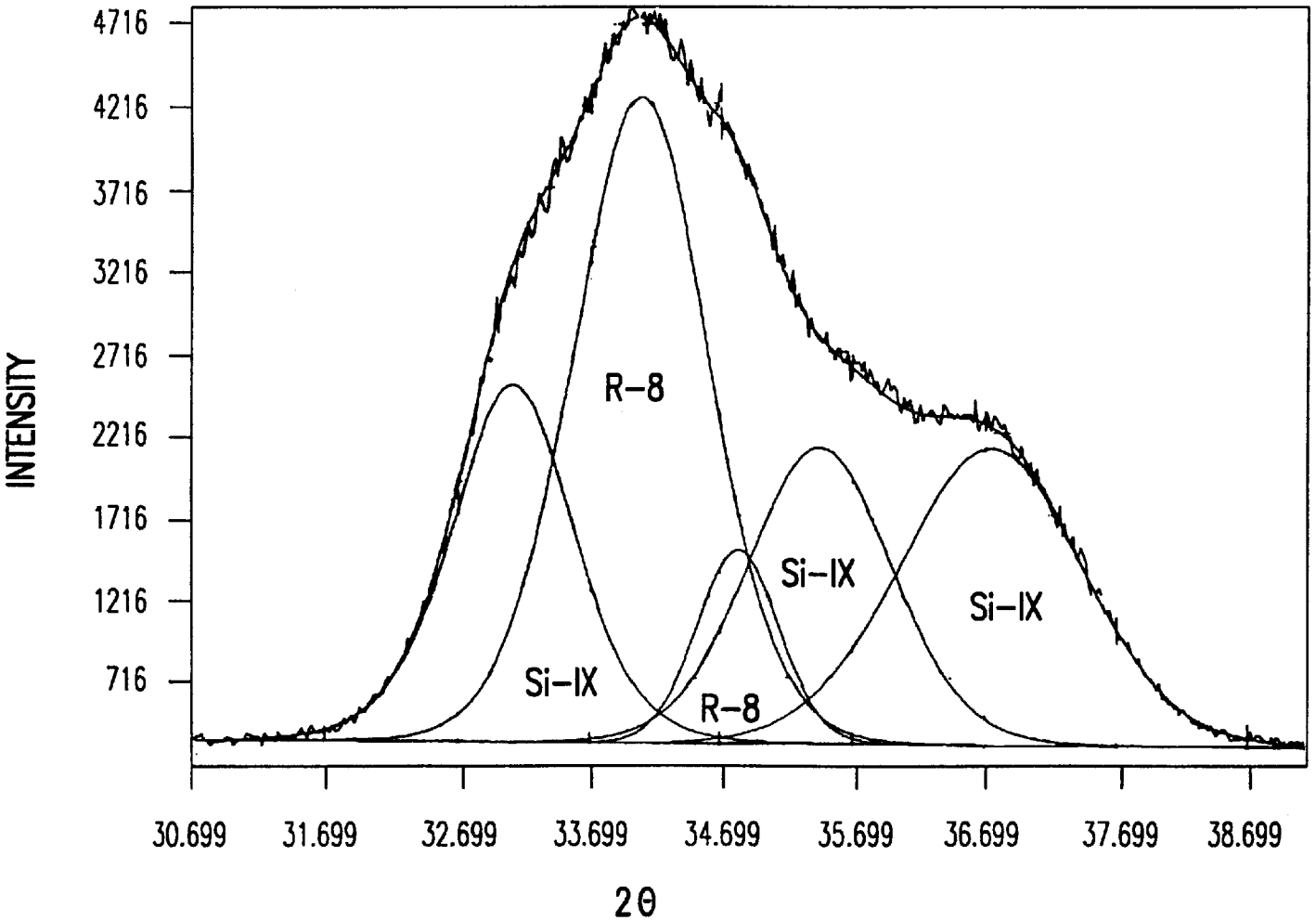
FIG. 2 is a de-convoluted peak analysis of the broad peak in the XRD pattern shown in pattern C of FIG. 1.

The broad peak was de-convoluted in order to determine the contributing peaks. FIG. 2 shows the de-convoluted peaks of the two overlapping peaks that form the broad peak of VPS deposit shown in FIG. 1, pattern C. The magnified view of the peak shows that shoulders at either side of the main peak occurred at ≈34°. A prominent shoulder also exists at higher angle ≈36.7°. The de-convolution, which was done assuming Gaussian peaks with variable peak width and peak position, produced peaks centered at d-spacings of 0.269, 0.264, 0.26, 0.256 and 0.245 nm. These values matched the d-values for Si-IX and R-8 phases (high pressure phase Si).

The percent by volume of nanocrystals in the VPS coating of FIG. 1, pattern C, was calculated from the relative intensity of the prominent XRD reflections. The VPS deposit was calculated to contain approximately 20% by volume of high pressure phase, nanocrystals.

As will be apparent from FIG. 1, Pattern E, Si deposited on the Si (111) substrate did not exhibit a broad peak that would correspond to high pressure phase of Si. The broad hump was not observed because of the volume fraction the high pressure phase formed on the (111) substrate was below 2%. This behavior can be correlated with the anisotropic nature of the pressure-induced transformation of Si-I.

The particle size of the VPS deposit of FIG. 1, pattern C was estimated using the major peak and the equation:

$$t=0.9\lambda/B\cos(\theta)$$

where B is the width at half maxima, λ is the wave length and $\theta_B$ is half the Bragg angle. The particle size of Si-IX and R-8 were calculated to be approximately 4 to 5 nm and 5 to 6 nm, respectively.

Figure 3:
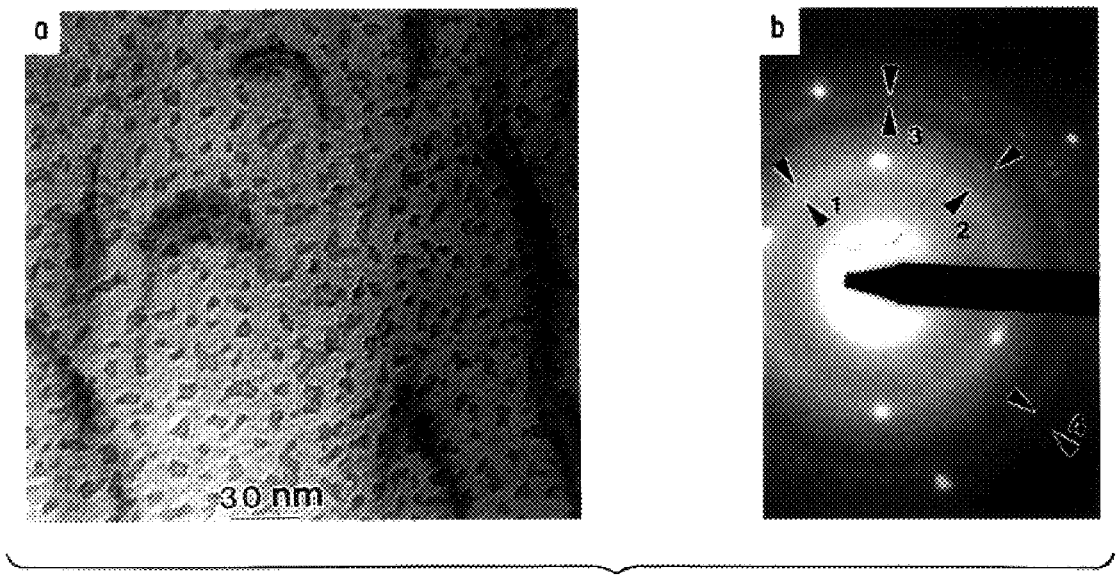
FIG. 3, Panels A & B, are: (A) a transmission electron micrograph of a section of a Si nanocomposite coating deposited on a Si (100) wafer by Vacuum Plasma Spray; and (B) an electron diffraction pattern of the micrographed section shown in Panel A.

The particle size of the high pressure Si phase was confirmed with TEM. As can be seen from FIG. 3, Panel A, the VPS deposit of FIG. 1, pattern C contains a very fine, homogenous dispersion of high pressure phase particles in the Si-I matrix. The particle size was ascertained to be approximately 2 to 5 nm in diameter. FIG. 3, Panel B is an electron diffraction pattern (DP) of a section of the VPS deposit which shows the presence of several broad rings in addition to (111) Si-I reflections. The four broad rings numbered 1, 2, 3, and 4, as shown in FIG. 3, Panel B are in the d-spacing range of 0.33 to 0.29 nm, 0.285 to 0.243 nm, 0.21 to 0.19 nm and 0.185 to 0.165 nm, respectively. The broad ring 1 and part of ring 4 contain predominately major reflections of hexagonal diamond-Si and thus indicates the presence of this high pressure phase. Rings 2, 3 and 4 indicate the presence of BC-8 and Si-IX. In fact, the broad peak in FIG. 1 has the same d-spacings range of ring 2. Accordingly, the XRD and electron patterns confirm that the nanocrystals are high pressure phases of Si.

Figure 4:
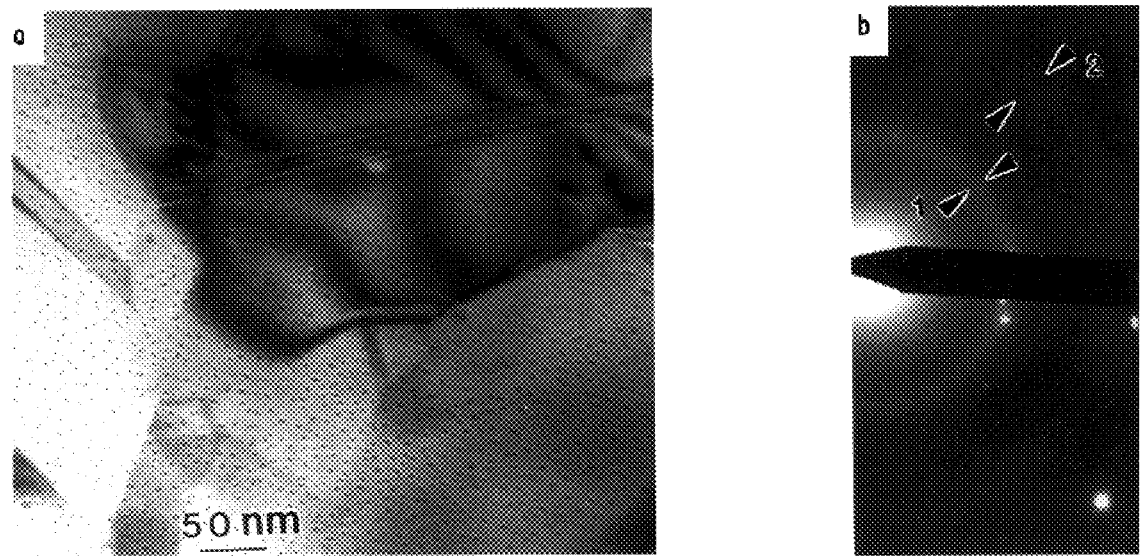
FIG. 4, Panels A & B, are: (A) a transmission electron micrograph of another section of the Si nanocomposite coating shown in FIG. 3; and (B) an electron diffraction pattern of the micrographed section shown in Panel A.

Another section of the VPS deposit was examined by TEM and electron diffraction, in which hexagonal diamond Si was determined to be the majority high pressure phase present. FIG. 4, Panel A is a bright-field micrograph of this region. The particle size was calculated to be approximately 2 to 5 nm, which is consistent with the other regions of the VPS deposit. The corresponding electron diffraction pattern, FIG. 4, Panel B, shows two broad rings corresponding to the d-spacings of 0.33 to 0.285 nm and 0.18 to 0.165 nm. The d-spacing values correspond to hexagonal diamond-Si.

Figure 5:
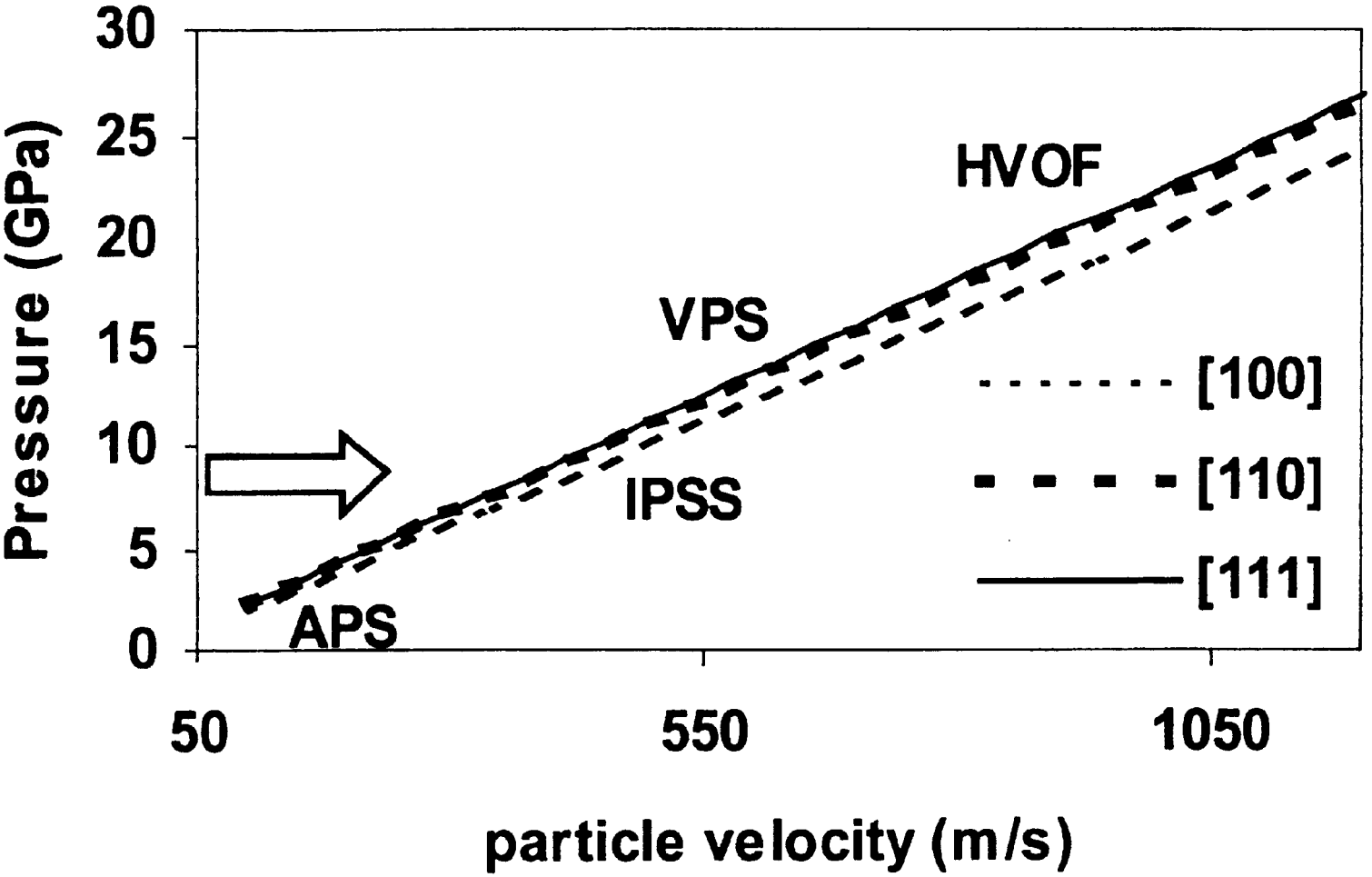
FIG. 5 is a plot graph illustrating calculated Hugonoit pressure as a function of particle velocity for Si coatings deposited on Si wafers in (100), (110) and (111) orientations with four thermal spray processes (APS, VPS, IPSS and HVOF).

The relationship between Hugonoit pressure and the velocities of impacting particles upon Si-I substrates in three different crystallographic orientations are graphically depicted in FIG. 5. The arrow indicates the pressure level sufficient to trigger the transformation from non-nanocrystalline, atmospheric phase Si to nanocrystalline, high pressure phase Si. The transformation pressure level was about 9 GPa, which occurred at a velocity of approximately 350 m/s. Thus the plasma spray techniques VPS, IPSS and HVOF were able to trigger the formation of the nanocrystalline, high pressure phase deposits, but the lower velocity APS process was not.

EXAMPLE 2

The effect of using velocities in excess of the required velocity for phase transformation was ascertained. Following the procedure of Example 1, a Si coatings between 15 to 30 micrometers was deposited on Si (100) and (111) wafers using the HVOF process described in Table 2.

TABLE 2

Process Parameters for Thermal Spray Technique

| Spray Process/Spray Gun | Gas Composition | Velocity (m/s) |
|---|---|---|
| HVOF (Diamond Jet-METCO) | $C_3H_6 + O_2$ + air | 800–1200 |

Figure 6:
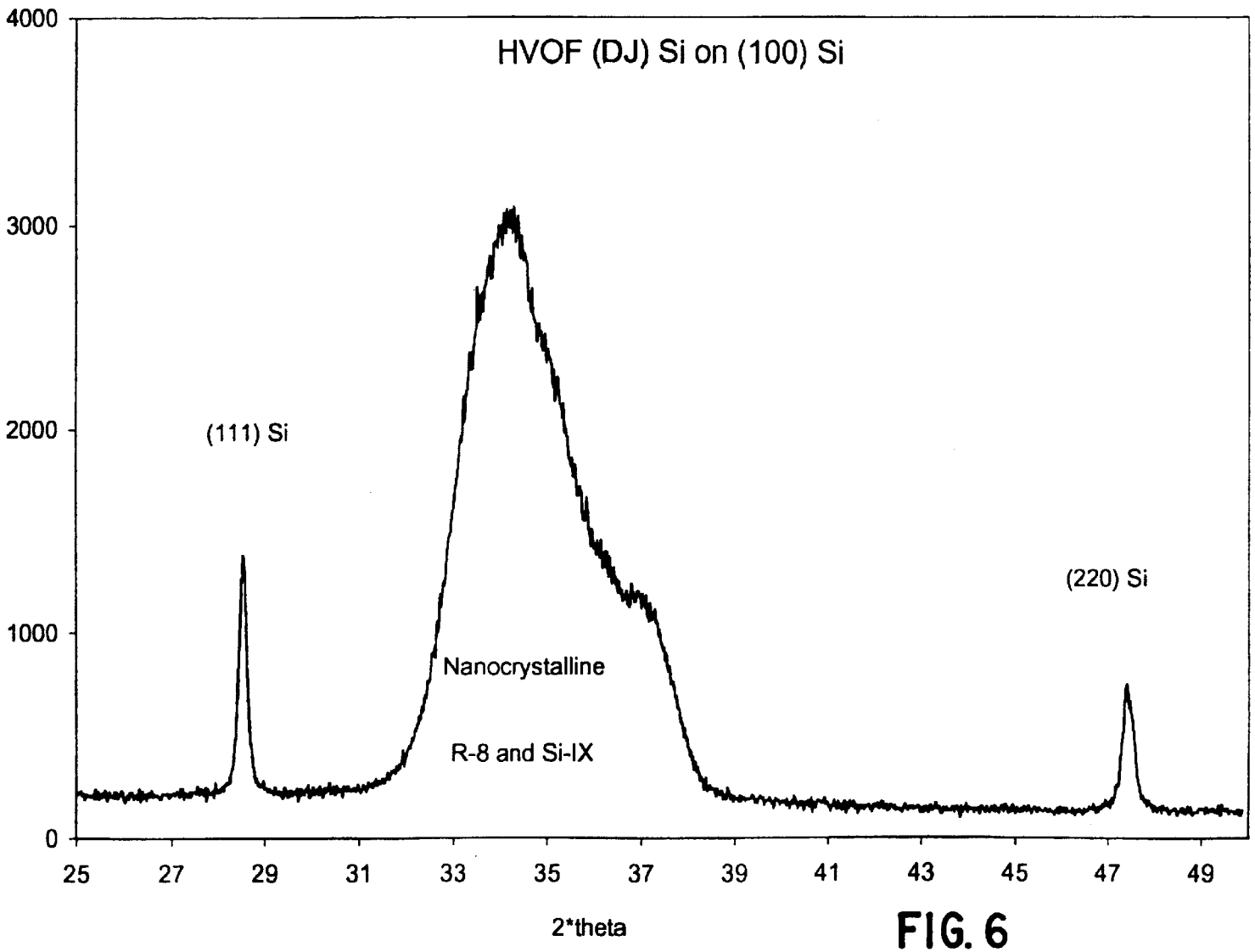
FIG. 6 is an XRD pattern of a Si coating deposited on a Si (100) wafer with HVOF using a high velocity spray gun.

The coatings were examined by x-ray diffraction (XRD) as in Example 1. The XRD pattern for the Si deposit on a Si wafer in the (100) orientation is shown in FIG. 6. Readily apparent from FIG. 6 is a broad peak in the 2θ range between 31.7 to 38.6, which represents nanocrystalline, high pressure phase Si. From the XRD patterns, the nanocomposite coating was calculated to contain approximately 50% by volume nanocrystalline Si.

EXAMPLE 3

Figure 7:
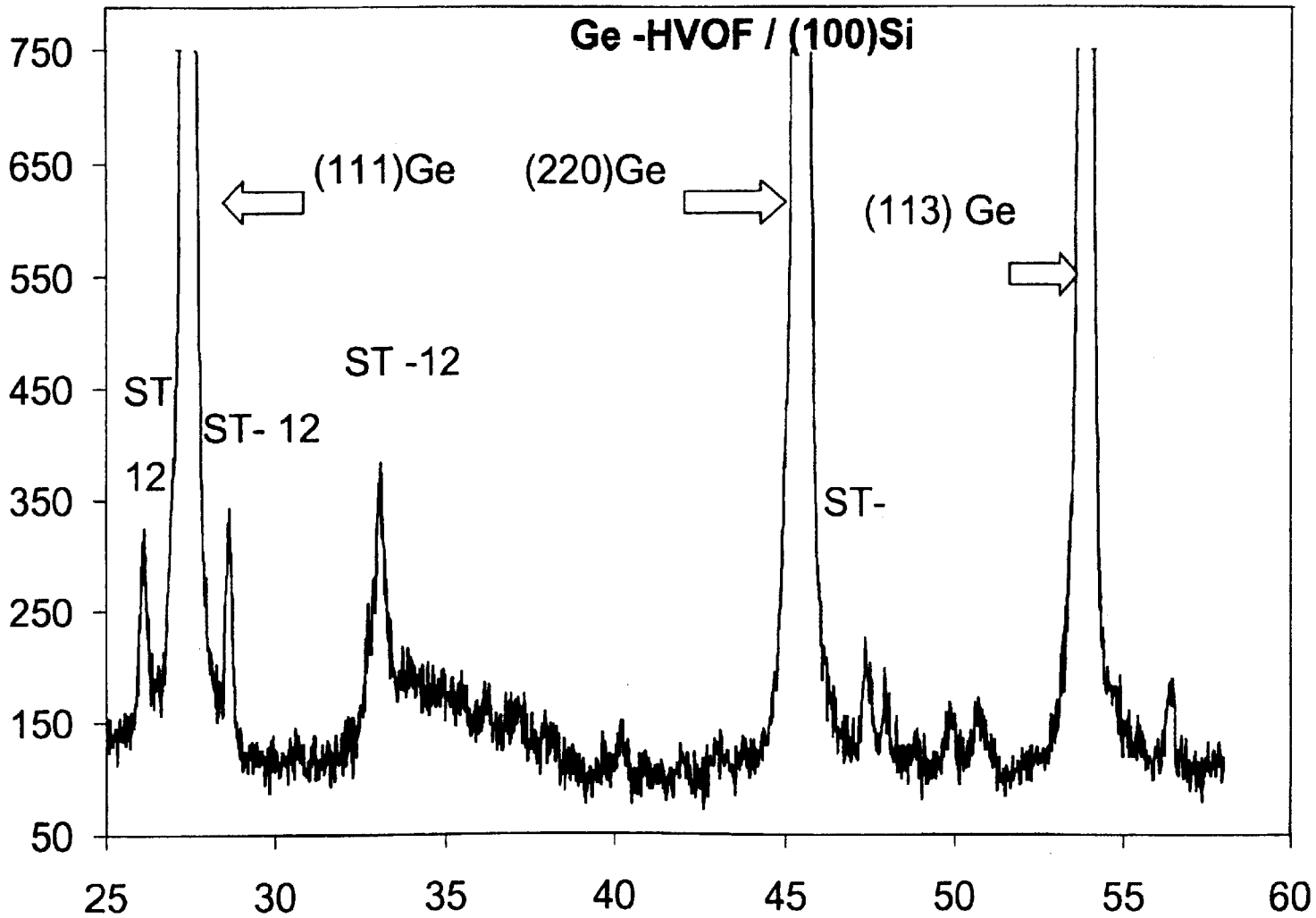
FIG. 7 is an XRD pattern of a germanium (Ge) coating deposited on a Si (100) wafer using HVOF.

A nanocomposite coating of Germanium (Ge) on a Si (100) wafer substrate was prepared following the procedure of Example 1 using HV-2000 gun to spray the Ge deposits of approximately 30 micrometer thick. The particulate ranged in size from 5 to 30 micrometers as in Example 1. FIG. 7 is an XRD pattern of the nanocomposite coating. Clearly evident from the pattern is a broad peak in the 20 range of 32 to 39 indicating the presence of nanocrystalline, high pressure phase Ge, in addition to atmospheric Ge. One of the high-pressure phase was determined to be ST-12. Particle size calculated from the peak broadening was determined to be about 5 nm. The nanocomposite coating was calculated to contain at least 5% by volume nanocrystalline Ge.

We claim:

1. A method of producing a nanocomposite coating, which comprises:

providing a thermal or plasma spray apparatus capable of generating a high-velocity gas jet;

providing a substrate to be impinged by said gas jet;

generating said high-velocity gas jet; and introducing into said gas jet a particulate comprising a polymorphic material in a non-nanocrystalline atmospheric phase; wherein said substrate is positioned at a distance from said spray apparatus whereby said particulate impinges said substrate at a velocity effective to induce transformation of at least a portion of said polymorphic material to a nanocrystalline, high pressure phase.

2. The method of claim 1, wherein said particulate is dispersed in a carrier gas prior to being introduced into said high-velocity gas jet.

3. The method of claim 1, wherein said particulate has a particle size from 1 to 100 $\mu$m.

4. The method of claim 3, wherein said particle size is from 5 to 50 $\mu$m.

5. The method of claim 1, wherein said substrate is an inorganic material.

6. The method of claim 5, wherein said inorganic material is metal.

7. The method of claim 5, wherein said inorganic substrate is a non-metal.

8. The method of claim 7, wherein said non-metal substrate is silicon.

9. The method of claim 1, wherein said particulate is a semiconductor.

10. The method of claim 9, wherein said semiconductor is selected from the group consisting of silicon, germanium, doped derivatives thereof, and combinations thereof.

11. The method of claim 1, wherein said velocity is greater than said velocity effective to induce transformation of at least a portion of said polymorphic material to said nanocrystalline, high pressure phase.

* * * * *